United States Patent [19]

Cooperman

[11] Patent Number: 4,596,123

[45] Date of Patent: Jun. 24, 1986

[54] FROST-RESISTANT YEAR-ROUND HEAT PUMP

[76] Inventor: Curtis L. Cooperman, 210 N. Kalaheo, Kailua, Hi. 96734

[21] Appl. No.: 569,556

[22] Filed: Jan. 9, 1984

Related U.S. Application Data

[63] Continuation-in-part of Ser. No. 352,088, Feb. 25, 1982, abandoned.

[51] Int. Cl.[4] ..... F25B 5/00

[52] U.S. Cl. ..... 62/199; 62/235.1

[58] Field of Search ..... 62/230, 235.1, 197, 62/198, 199, 200, 160; 237/2 B; 126/422, 444, 446, 445

[56] References Cited

U.S. PATENT DOCUMENTS

| | | | |
|---|---|---|---|
| 2,332,981 | 10/1943 | Anderson | 62/525 X |
| 2,720,084 | 10/1955 | Hailey | 62/200 X |
| 3,350,897 | 11/1967 | Plaster | 62/230 X |
| 3,643,462 | 2/1972 | Eberhart | 62/196 |
| 4,065,938 | 1/1978 | Jonsson | 62/235.1 X |
| 4,163,369 | 8/1979 | Owen | 62/235.1 |
| 4,211,207 | 7/1980 | Molivadas | 237/2 B |
| 4,211,209 | 7/1980 | Gay | 126/422 |
| 4,226,604 | 10/1980 | Weis | 62/235.1 |
| 4,242,873 | 1/1981 | Hino | 62/235.1 |
| 4,250,712 | 2/1981 | Meloni | 62/235.1 |
| 4,302,942 | 12/1981 | Charters et al. | 62/235.1 |
| 4,352,272 | 10/1982 | Taplay | 62/235.1 |
| 4,373,353 | 2/1983 | Anzalone | 62/200 |

*Primary Examiner*—Harry Tanner

*Attorney, Agent, or Firm*—Amster, Rothstein & Engelberg

[57] ABSTRACT

This invention is an improved refrigerant-cycle heat pump that requires neither a defrosting means nor a backup heat source. From widely varying outside environments, it pumps heat to heat living spaces or domestic hot water. Liquid refrigerant flows from a receiver through expansion valves into an outside evaporator consisting of a segmented array of plates where heat is absorbed from the atmosphere to evaporate the refrigerant. The resultant gas is compressed by a motor-driven compressor, gives up heat in a condenser, becomes liquid, and returns to the receiver. The segmented evaporator enables the self-governing heat pump system to choose the proper magnitude of evaporator area, in response to its determination of compressor suction pressure or motor power demand, so as to provide a steady refrigerant flow to the compressor and thereby maintain optimum heat pumping despite extreme excursions of outside temperature. The configuration of evaporator segments as plates enables the system to operate without interruption or performance deterioration even though frost or ice forms on plate surfaces.

30 Claims, 6 Drawing Figures

FIG.2
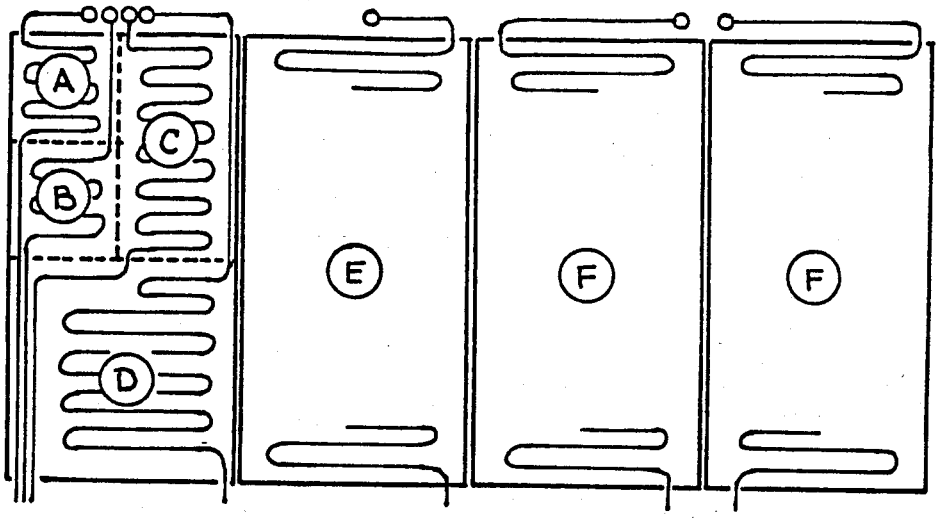
Zoned Evaporator
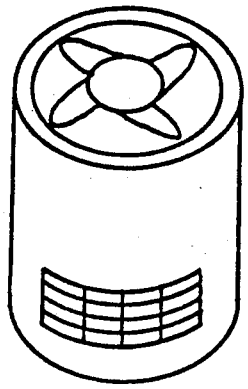
FIG.3
Conventional Fixed Size Finned Coil Evaporator

FROST-RESISTANT YEAR-ROUND HEAT PUMP

This is a continuation-in-part of Ser. No. 352,088 filed Feb. 25, 1982, now abandoned, by Curtis L. Cooperman for ALL-WEATHER SOLAR HEATING SYSTEM WITH VARIABLE-SIZE EVAPORATOR AND CONTROLS.

BACKGROUND AND REVIEW OF PRIOR ART

Heat pumps using existing refrigerant-cycle technology absorb heat from an outside environment with a fixed-size evaporator in which a refrigerant converts from liquid to gas. They compress the gas, which reverts to liquid form in a condenser and gives up heat for space heating or for domestic hot water. Performance of these conventional heat pumps suffers from their inability to accommodate wide variations in the amount of heat available to the evaporator from the environment due to changes from summer to winter and from day to night.

Evaporator size for a conventional heat pump is dictated by such factors as the desired heat pumping capacity of the system, refrigerant characteristics and the highest outside temperature expected. As outside temperature falls it is a natural result of fixed-size evaporator performance that the heat output of a conventional heat pump falls accordingly—just when most needed. (This effect is discussed and charted in more detail later in this application.)

Skilled workers in the heat pump field have failed to discover a useful improvement which would enable a heat pump to continue steady performance during periods of falling temperatures instead of showing the customary fall-off in output.

Another deficiency of conventional heat pumps is that they slowly become non-functional when moisture in the air moving over cold evaporator coils deposits onto them as frost, which accumulates and impedes air movement and reduces heat absorbing capability. Special means must therefore be included to overcome the frosting problem. Such means commonly take the form of furnishing heat to the evaporator to melt frost away. Meeting this requirement entails a triple loss: (1) Heat pumping capability is reduced as frost forms, (2) Heat pumping is partially or entirely suspended while frost is melted and (3) Heat used to melt frost is lost to the environment—after the heat pump has worked to bring in heat from that environment.

Existing heat pump technology can't satisfy every goal for system optimization, so what results is a conventional heat pump system, plus a backup heat source for the coldest periods, plus added-on provisions for melting evaporator frost, plus safety devices to shut the system down if warm weather conditions overstress the heat pump. The fundamental problem is that a heat pump designer can't satisfy every requirement for evaporator sizing. A large evaporator is needed on cold days so that a large amount of heat transfer can keep the pressure of evaporated refrigerant up to the value required for normal system operation. But a large evaporator's output on warm days will be at temperatures and pressures far above those the evaporator and compressor can tolerate. When a designer specifies a smaller evaporator that won't harm the rest of the system on hot days, it frost up on cool days. The heat pump designer is compelled to provide a crutch for the system—a way to defrost the evaporator, with the added complexity and loss of efficiency such a requirement brings to the system.

Strong needs have existed for many years for heat pumps that would not have these two major problems and other deficiencies. Heat pumps became commercially available in the 1950's, but they are still not widely used because of their obvious drawbacks. Even the most skilled workers in heat pump field have treated the symptoms instead of the causes. Instead of solving the basic problems by devising a new and improved heat pump system able to operate over an extreme range of outside temperatures and without being hampered by frost deposition, they have devised clever methods for melting ice and frost from evaporators, they have devised protective measures caused by fixed-size evaporators absorbing too much heat, they have used evaporators whose maximum size was dictated by maximum pressures to be experienced, and they have made sporadic attempts to do something about evaporator size inflexibility. But even the emphasis added by the energy crunch instituted in 1973 by the oil embargo has not resulted in solutions to these basic difficulties.

My invention, admittedly appearing simple and obvious, aims at a solution to these basic difficulties brought about by a combination of improvements that apparently had not been obvious to workers in the heat pump field who were concentrating on alleviating the symptoms of being hampered by frost and being unable to pump heat from low temperature environments.

Taplay(U.S. Pat. No. 4,352,272, Oct. 5, 1982), for example, stating that " . . . the coils of an ambient air absorber must be defrosted periodically . . . ," disclosed a mode of operation in which defrost heat is applied to a primary ambient air heat absorber both from an electrical heater and also from hot refrigerant gas while heat pump operation goes on at reduced capacity using a secondary heat absorber " . . . which can be of same type, or of the type obtaining heat from solar insolation, water, ground heat, etc. . . . "

Lindahl et al (U.S. Pat. No. 4,122,686, Oct. 31, 1978) disclosed a way to work the defrosting chore by isolating one segment of a multi-segment evaporator and sending hot refrigerant from the system through it. This is the scheme, also, of Mochizuki et al (U.S. Pat. No. 4,122,688, Oct. 31, 1978).

Karlsson's brute force method of defrosting an outside evaporator (U.S. Pat. No. 3,995,809, Dec. 7, 1976) was to use not one but two heat pumps. An "auxiliary" heat pump comes on when the "base" heat pump cannot "sufficiently heat the room," and the operation of the auxiliary heat pump is reversed when the somewhat common evaporator frosts up, and room heat is sent out to melt the frost with a portion of the evaporator acting as a condenser. Hailey (U.S. Pat. No. 2,720,084, Oct. 11, 1955) found a use for evaporator ice. But it's a use that helps only a cooling system, not a heat pump. The system turns ice to advantage by using it as a heat storage mechanism, adding sections of evaporator " . . . so as to maintain substantially constant the heat transfer to the evaporator until all of the evaporator has been coated with a sufficient coating of ice so that during the heat demand the ice may be melted to provide the necessary cooling in excess of the full load rating of the compressor."

Jonsson (U.S. Pat. No. 4,065,938, Jan. 3, 1978) made a slight advancement in the fundamental heat pump art—but he still treated a symptom. His heat pump system used a basic evaporator to which was added the capacity of a booster when it could be used without raising the pressure beyond safe limits for the compressor. But the disclosure didn't include a cure for the basic problem because it still provided " . . . means for defrosting said booster heat exchanger, by periodically reversing refrigerant flow."

Anzalone (U.S. Pat. No. 4,373,353, Feb. 15, 1983) throttled refrigerant flows in a number of evaporator circuits, saying that this mode of operation resulted in a higher efficiency than obtained by previous methods that throttled flow to a single evaporator.

Such control of the working size of an evaporator is a concept old in the art; Anderson (U.S. Pat. No. 2,332,981, Oct. 26, 1943) applied the idea of a variable surface evaporator to the air conditioning system (not a heat pump) used in a railroad passenger car, to avoid excess pressure at the compressor suction.

The troublesome symptom of compressor overload in a heat pump system was addressed by Weis (U.S. Pat. No. 4,226,604, Oct. 7, 1980) for a system using a heat absorber of the solar insolation type. In such a system, the possibility of large and rapid changes in insolation aggravate the difficulty. Weis disclosed a mode of operation in which the temperature of gas leaving the evaporator was sensed and " . . . if an overheated condition is detected, bleeding off a portion of the refrigerant mixture entering the collector and mixing it with the overheated vapors to cool them down before they enter the compressor."

Adaptation of solar insolation collectors for use as heat absorbers in refrigerant cycle heat pump systems, as in Weis, required little innovative advancement. Their use as outside heat collectors was known in the solar heating system art, as in Gay (U.S. Pat. No. 4,211,209, July 8, 1980), who disclosed plates encased in transparent plastic boxes to capture solar insolation and transfer the heat to a fluid flowing through the plates, the box serving to minimize escape of heat from the plates to the atmosphere, with manifolding to equalize flow of fluid among the several plates.

A parameter in a heat pump system whose value is critical and can thus be sensed as an indicator of the need for control of evaporator size is evaporator output pressure, which is the pressure at the suction intake of the compressor. This establishes the magnitude of the compressor load. The compressor load directly affects the compressor motor's power demand, of course, so motor current is also an indicator. The patents of Weis, Jonsson and Anderson use systems that sense such parameters, a technique old in the art, evidenced, for example, in the disclosure of Plaster, (U.S. Pat. No. 3,350,897, Nov. 7, 1967). Plaster cites these parameters as signal sources for use in controlling the spin vanes of a centrifugal refrigeration compressor to adjust its capacity to the needs of a refrigeration system.

These skilled workers in the heat pump field strove to create a more satisfactory heat pump system, bringing into play the mechanical and creative skills they possessed. But there still remained several old and recognized wants: (1) The ability to pump heat in a refrigerant system without the penalty of having to defrost an evaporator, (2) The ability to pump an unfluctuating amount of heat in spite of wide fluctuations in outside ambient conditions, (3) The ability to use refrigerants to produce a colder evaporator (providing a larger temperature difference between the environment and the evaporator) so a heat pump could operate at much lower ambient temperatures, and (4) The ability to establish an operating value of —to "dial in"—the temperature at which an evaporator operates in order to create a greater temperature difference ("Delta T") between the evaporator and the ambient environment. These skilled searchers sought but failed to find a principle or mode of heat pump operation that could solve these problems.

Now, my invention affords success in these four problem categories. It does so by a new combination of old elements cooperating in a new, useful and previously unobvious manner to produce an improved result. Others skilled in the art had not devised an equivalent combination of elements and a mode of operation which would free a heat pump system from the restrictions and difficulties of these problems.

SUMMARY OF THE INVENTION

The fundamental principle of operation of my invention is the same as that of a heat pump built with existing technology. The names of its components are exactly those of the components of conventional heat pumps. A receiver holds liquid refrigerant. Liquid refrigerant flows through expansion valves into an evaporator exposed to the outside atmosphere. Heat absorbed from the air converts the refrigerant from liquid to gas. The gas is piped to a compressor (driven by an electric motor) where it is compressed into a hotter and higher pressure gas. The hot gas is piped to a condenser (heat exchanger) where heat is given up to a desired use (either heating a living space or heating domestic hot water) as the hot gas returns to a liquid state. The liquid refrigerant returns to the receiver.

It is the configuration and control of the evaporator portion of the heat pump that is novel in my invention. Its physical form and its variable-area attributes enter into a synergistic combination which enables a heat pump system to do what no previous heat pump system has been able to do.

The physical form of the individual elements of the evaporator is that of a flat plate instead of the customary finned coil with a motor-driven fan to move air through the coil bank. The plate is made of two pieces of sheet metal roll-bonded together with expanded channels between the inner surfaces of the sheets forming conduits for refrigerant flow, accordingly having smooth but undulatory outer surfaces— waffled, dimpled, channeled, or the like—which it presents to the ambient atmosphere. There is no fan, no motor, no air-movement attachment; heat transfer takes place from air to refrigerant through the two outside plate surfaces, both of which are exposed to the air.

Variability of working surface area of the evaporator results from arranging refrigerant piping and valving that feed individual segmented portions of the evaporator so that a segment is supplied liquid refrigerant only when its control valve is opened. Increases in total evaporator working area, as additional segments are opened to liquid flow, step up in a progression that is more geometric than arithmetic. A possible arrangement might be (say, for refrigerant-22): Segment A, always operating, 24 square feet; segment B, next opened, 24 sq. ft. to make a total of 48 sq. ft.; segment C, 48 sq. ft., to make a total of 96 sq. ft. when added to A and B; segment D, 96 sq. ft., to make a total of 192 sq. ft. when added to A and B and C; and finally segment E, 192 sq. ft., to make a total of 384 sq. ft. when added to A and B and C and D.

These evaporator plates are mounted in the outside environment with both sides of all plates exposed to the air. Installation on vertical walls instead of on roofs or other horizontal surfaces is preferable for factors of esthetics, of economy of mounting methods and lengths of piping, of considerations of structure maintenance (roofs seem to need repair more often than vertical walls) and shielding of the structure from winds, along with the need to minimize or prevent snow from accumulating on the plates. Reception of solar insolation is not a primary requisite.

Control of which portions of the evaporator receive liquid refrigerant is done by sensing compressor suction pressure or compressor motor current demand. In this way the system becomes self-governing, using an appropriate evaporator capacity to send a steady flow of gas to the compressor at the appropriate pressure for the system to operate at or near its maximum capabilities for pumping heat—on a cold winter night or on a hot summer day.

In operation, when a room thermostat (for example) calls for heating, all control valves for all evaporator segments are open and liquid refrigerant flows from the receiver into them. With the evaporator correspondingly at its maximum heat absorbing capacity, gas pressure climbs quickly, the compressor starts, and the system begins to pump heat quickly. Unless outside temperature is at winter's coldest, suction pressure soon (within seconds) rises above a preset control value and the largest evaporator segment is shut off by its control valve under command of the suction pressure sensor. At the existing outside temperature, if the remaining evaporator segments are more than enough for the compressor to maintain normal gas movement, a continuing rise in suction pressure will command the shutoff of another evaporator segment. The system will settle out at the proper combinations of evaporator area to enable the heat pump to do its optimum work. On a hot summer day, only the smallest segment of the evaporator will be working. On the coldest of winter nights, all zones of the evaporator will be required to absorb sufficient heat from the environment to maintan heat pump performance at maximum value. For times when conditions are between those two extremes, the evaporator will work at intermediate capacities. But at any condition, a maximum Btu flow will continue, suction pressure will remain at its proper value, and the compressor motor will draw its proper amount of power.

During seasonal changes of the ambient environment it is intriguing to watch evaporator operation in a working heat pump system of this type. Observation is made possible because presence of liquid refrigerant in a plate is—under most atmospheric conditions—prominently indicated by a layer of frost on the part of the plate where liquid has not been vaporized. Given proper balance between sizing of a zone and expansion valve size feeding it, the zone should appear some 98 percent "frosty." As zones are automatically switched in and out, the working area can be identified as the zones which are frosted. Frost does not degrade performance of the evaporator plates, means are not required to melt the frost away and the overall heat pump system keeps on working without interruption and without lessening of heat pumping capability. Unlike a finned coil evaporator where frost and ice interfere with air flow and greatly diminish heat transfer—or stop it entirely by preventing air flow over the fins' surfaces—the flat plates of this evaporator continue to absorb heat and transfer it to the refrigerant. If a layer of frost does, by its insulating property, slightly reduce heat flow per unit area, flow to the compressor is maintained at the desired value as the system simply calls for more evaporator area and thereby keeps total heat absorption constant.

(It may be thought that an evaporator segment which is shut off might become over-pressurized as its temperature rises, and thus affect suction pressure. But a sun-struck shut-off plate may have a surface temperature of 60° C. (140° F.) and a sun-struck working plate may have a surface temperature of −12° C. (10° F.), for example, without any bad effect because the hotter plate has boiled its refrigerant out into the normal pressure existing in the common exit manifold of the entire evaporator.)

It is in this manner that my invention satisfies the old and recognized want for a year-round complete heating system immune to the hazard of evaporator frosting. This combination of prior art elements previously known for their individual properties but never before combined in this manner brings into being something new in the art, this heretofore unobvious—and unobtainable—mode of operation of heat pumps.

Significant as that new and useful result appears to be, perhaps a more important outcome for future exploitation (not envisioned as an objective during initial development) is that this heat pump can successfully use refrigerants heretofore deemed unsuitable. Refrigerants with lower boiling points enable the evaporator plate array to be smaller and less costly yet produce more heat absorption. (The critical temperature of the refrigerant selected should be, of course, high enough that heat can be transferred to the desired medium at a temperature appropriate for efficiency and comfort.) The refrigeration industry has been incapable of full utilization of available refrigerants in conventional heat pumps; this new mode of operation opens up a new avenue of development with opportunities to discover heat pump capabilities using refrigerants not yet applied to that use because of control difficulties—and even beyond that with refrigerants that can be developed to meet the expanded heat pump capabilities this new mode offers.

It has been observed in operating heat pumps of this type that opportunities exist for raising coefficient of performance (COP) values because this invention and the heat pump designs it fosters can "control the refrigerant" instead of the refrigerant's characteristics controlling the design and performance of the heat pump. By setting the values at which the sensors control the different working areas of the evaporator, it is possible to "dial in" desired optimum pressure and temperature of evaporator working conditions and have the heat pump maintain the chosen flow of refrigerant to the compressor at the suction pressure and temperature to provide best operation.

That such a seemingly simple concept—assembling old elements into a new combination—brings such an added benefit did not become apparent until experimental-hardware work led to the trial of refrigerant-22 in a heat pump that has used refrigerant-12. R-22's low boiling point enabled heat pumping down to sub-zero (F.) outside temperatures, and only slight modifications in the evaporator system's zone sizes and expansion valves were required to suit the characteristics of the new refrigerant. This effect of being able to exploit low boiling point refrigerants, while new and highly useful in the heat pump art, was unusable by previous workers in the heat pump field because fixed-size evaporator heat pumps would create system overpressures at ambient temperatures in the "cool" range from 21° C. (70° F.) down to perhaps 7° C. (45° F.). This problem was described in Jonsson's patent in the words "One possible approach to increasing the suction temperature of the compressor in the heating mode would be to simply enlarge outdoor coil 28 to enable it to absorb more heat from the air forced over it. This approach is unsatisfactory for a variety of reasons. First, a larger coil 28 would produce very large heat inputs at the higher ambient temperatures, with the result that the maximum acceptable suction temperature for compressor 10 would quickly be exceeded in the heating mode."

It was a primary object of my invention that as outside temperature drops there should be no drop in this heat pump's Btu output, a drop that follows ambient temperatures down to freezing in conventional systems. Some of the major benefits accruing from the achievement of such performance with my invention are: (1) Hotter air delivered (to the living space, providing not only reduced operating time but also improved comfort feelings for occupants), (2) Same amount of Btu delivered (regardless of ambient temperature falling to values far below those at which conventional heat pumps operate satisfactorily, and self-adjusting to compensate for climatic changes and different geographical installations), and (3) No backup or heat storage means needed (because this invention can deliver heat at any time in any weather).

That this primary object has been attained can be illustrated by a graphic comparison of the performance of a typical conventional heat pump and the performance of a typical heat pump using the mode of operation of my invention. Referring to FIG. 1, the Performance Lines graph shows the typical drop in pumping capacity of the conventional system with a corresponding drop in condenser output temperature as the outside temperature decreases (shown by the performance line X-Y), due to the inability of a fixed-size evaporator to absorb sufficient heat at lower ambient temperatures. The heat pump of my invention (in this example, R-22 is the refrigerant used by both systems) continues to put out a higher condenser output temperature over the range of falling ambient temperatures until the temperature falls to −18° C. (zeroF) and below (with this refrigerant). The level portion of the performance line of my invention's system shows how the self-governing evaporator ability enables the system to put out a constant flow of Btu at a constant high temperature over the range of ambient temperatures from 35° C. (95° C.) down to 17° C. (63° F.). Use of refrigerants with higher critical temperatures will move the performance line of the system of my invention in the direction of the A arrow; dialing in lower evaporator temperatures will move the performance line in the direction of the B arrow. The conventional heat pump's output temperature is lower than that of my invention at an ambient temperature of 21° C. (70° F.) because the conventional system must be designed with a safety factor that will allow for higher ambient temperatures that create overpressures at the compressor.

As an example of my invention's actual operation with R-22, a single plate evaporator of 24 square feet in an ambient temperature of 38° C. (100° F.) on a cloudless day absorbed the heat that a conventional finned coil evaporator was absorbing in an ambient temperature of 21° C. (70° F.), both sending to the compressor corresponding amounts of vaporized refrigerant at corresponding pressures. Yet the zoned evaporator in a 21° C. (70° F.) ambient could, by expanding its area to two plates, continue to send to the compressor the same amount of gas at the same pressure and temperature. The plate evaporator continued to send to the compressor the same amount of gas at the same pressure and temperature as the evaporator's working area expanded to four plates and then eight, as the ambient temperature dropped to levels where the finned coil evaporator's performance fell off to essentially nothing.

For a conventional fixed-size evaporator, the designer must balance factors of (1) finned coil area (which sets evaporator capacity), (2) air movement, (3) output pressure, (4) refrigerant characteristics and (5) expected maximum ambient temperatures, in choosing a configuration that will suit expected conditions. It would be possible to achieve better heat pump performance if the design could be aimed at a larger temperature difference—"Delta T"—between the ambient air and the refrigerant within the evaporator coils, but such a choice means that the evaporator will frost up more quickly under a narrower operating range of ambient conditions. In my invention, however, because the design parameters are in no manner constricted by the possibility of degradation of performance caused by frosting, it is possible to design—and in operation to dial in—suction pressures that result in larger Delta T's.

A designer working within the confines of conventional technology of fixed-size finned-coil evaporators that require defrosting is forced to specify (for the refrigerant he selects) an evaporator large enough that it will frost up "late" in the fall of ambient temperature from a high value of, say, 21° C. (70° F.) down to values of, say 10° C. (50° F.) down to zeroC° (32° F.); as the ambient temperature moves into the lower range the frosting occurs and must be dealt with. This is the region of operation and temperature conditions used by previous heat pump systems, because if the designer attempts to raise the performance parameters of the heat pump by going to a larger Delta T (by going to a smaller evaporator or by increasing the cfm capability of the compressor, or by using a colder refrigerant, and thus lowering the suction pressure at the compressor), the evaporator would freeze up "earlier" in the drop of ambient temperature, say in the region from 16° C. (60° F.) down to 10° C. (50° F.). Attempts to alleviate the frosting problem by going to a refrigerant or a mode of operation in which frosting and icing occur even "later" in the drop in ambient temperature—say below zero C.° (32° F.)—results in a heat pump using a refrigerant with a warmer boiling point and, importantly for this example, a smaller Delta T and resultant poorer performance.

Summing up, with a fixed size finned coil evaporator the frosting stage of operation dictates a refrigerant with a boiling point near −40° C. (−40° F.). Operation of a fixed size finned coil evaporator with a colder characteristic in order to work with a larger Delta T would cause frosting and ice coating "earlier," with cessation of heat pumping at a higher than zero C.° (32° F.) ambient temperature.

Thus, the variable-area frost-resistant evaporator of my invention not only enables the heat pump designer to envision, design and build a system that can pump heat at maximum amounts over large temperature ranges, but it also opens up avenues for future development heretofore closed off. Because evaporator performance can be tailored to the characteristics of a particular refrigerant without having frosting considerations dictate which refrigerant must be used, an efficiency-raising Delta T can be attained using refrigerants with characteristics more closely suited to the heat pump application.

An even further advance may be possible in addition. If one can dial in a super-cold evaporator temperature at an extremely low suction pressure (as is possible with this system) using a refrigerant with a high critical temperature, even more improvement may be obtained because of the larger Delta T which would result. Such a refrigerant might be of a type such as R-11, whose use in conventional heat pump systems cannot be contemplated.

As an illustrative example of my invention's operation when compared with that of a conventional heat pump, consider that one portion of the zoned evaporator shown in FIG. 2 an ambient temperature of, say, 21° C. (70° F.). If a rise in ambient temperature occurs, the conventional evaporator's output pressure will rise and cause heat pump operation to be suspended. In my invention, such a temperature rise is accommodated by the system's closing off zone C, leaving A and B as the working evaporator. Further rises will cause the system to close off evaporator zone B, leaving the area of zone A as the working evaporator. In this way the heat picked up from the ambient air will continue to be the same and the system will continue to pump the same amount of heat.

Such action is desirable, not only for the customary space heating requirements, but is doubly advantageous when the heat pump is used for heating not only living spaces but other applications that conventional systems are unable to heat such as domestic hot water, swimming pool water, recreational water and the like, where heating is still required when ambient temperatures rise above the value where space heating is called for but the desired water temperature still calls for heat from the heat pump.

In a conventional heat pump, when the ambient temperature rises above 21° C. (70° F.) operation is suspended because the higher temperature will cause the evaporator to absorb more heat and will result in pressures at the compressor suction high enough to cause either cessation of heat pumping or activation of safety shutdowns. This is for a system using refrigerant-22, for example.

The self-governing nature of my invention enables it to operate at the same values as conventional heat pumps and then reduce to the minimum size of evaporator surface that accommodates the highest ambient temperature—and still pump heat for water heating.

And, when the ambient temperature drops, the finned coil fixed size evaporator's heat absorbing capability drops off accordingly, followed by an even more deleterious effect when defrosting must be done. Although the suction pressure drop helps the operation by increasing the Delta T, the heat comes in at a reduced rate because of the evaporator frosting. The overall result is, of course, that system performance suffers all the way down as temperature falls.

But the evaporator of my invention, under such a falling temperature condition, automatically becomes the zones of A, B and C plus zone D. If the ambient temperature drops further, the E zone is added and then, with a further drop, the F zone, enabling continuation of maximum heat pumping performance down to previously unreachable ambient temperatures.

It is this result, contributed by the variable-area frost-resistant evaporator, which enables operation of maximum heat pumping over a wide range of ambient temperatures—not beginning at 21° C. (70° F.) and dropping off with dropping temperatures as in conventional systems, but operating at temperatures far above 21° C. (70° C.) and continuing to pump maximum heat down to temperatures of −18° C. (zero F.°) and below.

This object of uniform heat output over a great range of ambient temperatures is attained in my invention by the mode of operation in which the heat absorption capability of the evaporator is automatically matched to the conditions of the heat pump and the outside ambient to produce the desired evaporation of refrigerant, by adjusting the working area of the evaporator over a range that may be thirty-two to one or greater. In the example just discussed (when the "normal" capacity of the finned coil evaporator is equivalent to that of my invention's evaporator zones A, B and C) the evaporator of my invention can decrease its equivalent size to one fourth that of the finned coil unit when ambient temperature increases, and can increase its equivalent size to eight times that of the finned coil unit when ambient temperatures fall.

Alterations of evaporator size was known in the prior art, of course, but it appeared to be unobvious to adapt that principle—as I have done—to make a heat pump capable—automatically—of operating over such a wide range of ambient temperature.

Jonsson's patent disclosed a "booster" to alter evaporator capacity, even though his object was only to extend heat pump operation down to perhaps freezing or slightly lower. Taplay, too, teaches adjustment of evaporator capacity, but only as an aid to defrosting. It was not apparent to any of these people skilled in the art and earnestly working in the field to try an idea for a greatly extended ambient temperature capability, probably because the successful realization of such a concept demands the solution of another difficult puzzler—an evaporator immune to frosting penalties, not to mention the necessity of using refrigerants then considered unsuitable for heat pump use.

Anderson's teaching of reducing evaporator size of a system which removed heat from a railroad car whose interior temperature remained relatively constant reduced the heat extraction capability of the evaporator in that constant temperature environment to protect the railroad car's air conditioning compressor. This is not the effect needed in the evaporator of a heat pump and provided by my invention, where a reduction in evaporator size is keyed to a rise in ambient temperature. Thus Anderson aimed only at adjusting the "surface of an air cooling, refrigerant evaporator, conformably with load requirements" and not, as in my invention, operating at a maximum continuous desired heating load with ambient air temperatures varying over extreme ranges.

When an overheat condition was detected, Weis's stratagem was to bypass the evaporator, sending colder refrigerant gas directly to the evaporator output to be mixed with the hotter gas there. This method might be used in the ambient air heat absorber of my invention as well as in the solar collector of Weis's patent, but the strategem is primarily a fail-safe device, not one that points the way to a solution of the fundamental problems of creating an evaporator that enables the heat pump to work at optimum capability over wide ambient temperature ranges with no frosting difficulties. Besides that, there is risk of sending liquid refrigerant on to the compressor and damaging it.

Gay's solar plates needed no "evaporator" sectioning, or pressure control, or the like, so his disclosure teaches nothing pertinent to the heat pump evaporator problem. And such an enclosing box as Gay teaches would be detrimental in a system such as mine because it would impede the flow of ambient heat to the surface of the evaporator plates.

It has been suggested by some persons skilled in the heat pump art that an effect similar to that of my invention's variable area evaporator could be provided by a "very sensitive thermal expansion valve assembly . . . well designed and integrated thermal expansion valve system." But experience teaches that it is difficult to adjust such an assembly to work satisfactorily over a large temperature range with a unitary evaporator, or to equalize flow among several evaporator sections if that approach is used in an attempt to minimize the difficulty. The end result is that liquid refrigerant may under certain conditions flow from the evaporator and damage the compressor—an ever-present possibility.

The second primary object of my invention—to escape entirely the difficulties and system complexities brought on by evaporator frosting—with the ability to use previously unusable refrigerants and the attainment of extended temperature range capability establishes a new combination of formerly separate elements to obtain a substantial advancement in heat pump technology. My invention achieves this second primary object by using plates with surfaces essentially flat when compared to customary finned coil structures. Both sides of the plates are exposed to ambient air from which heat is transferred by conduction to refrigerant flowing in conduits formed in the plates during fabrication in a serpentine pattern. My invention's inherent capability to add additional evaporator area by flowing refrigerant through additional plate segments means that if a frost layer does form, the evaporator's total capability to absorb heat can be kept at a desired level.

It may not be immediately obvious that the combination of ability to use a more suitable refrigerant in a frost-resistant evaporator of widely variable capacity means that the total evaporator is, so to speak, greatly oversized in comparison with that of a prior art heat pump. This "oversized" area of the evaporator results in performance without impairment down to previously unreachable outside temperatures, even using the same refrigerant. Yet in warmer and then hotter atmospheres the closing off of evaporator sections keeps the Btu flow constant and eliminates the possibility of system disablement or compressor damage. Such an improvement may seem obvious now, but apparently has been beyond the perception of either ordinary mechanics or skilled workers in the heat pump field.

Taplay, for example, didn't make the intuitive intellectual leap to the next level of improvement of heat pumps, this concept of combining elements to escape frosting difficulties entirely. Instead, he provided a solution not to the basic problem but to the subsidiary problem of evaporator frosting. The reason Taplay and others skilled in the art didn't see what (with my invention) is now obvious may be that such an improvement demands a parallel intuitive leap, that of providing the capability of controlling evaporator performance over a wide range of ambient temperatures and discarding the use of evaporator elements which can frost up.

Taplay reasoned that "preferably an electric defrost system is used to provide the defrost heat necessary to clear the outdoor air heat exchanger coil of accumulated ice." His system included a containment valve to keep higher pressure in the coil during defrosting to reduce the loss of energy. But the Taplay system not only loses the latent heat necessary to melt ice from the coil, but also complicates the system with the necessary valving and with the necessity of providing two completely different types of evaporator—"one of which is an ambient air heat absorber, and the other of which can be of the same type, or of the type obtaining heat from solar insolation, water, ground heat, etc." and with the necessity of providing electrical heaters for the main evaporator.

Others besides Taplay have mentioned the expedient of flat plates as outside evaporator means; some anticipated Tapley in actual use. One firm known to the inventor was, a decade ago, using fixed-size flat plate evaporators on roofs. Summer brought on high pressures to push compressors beyond their maximum range and winter brought on low pressures of refrigerant gas output, heat output of this heat pump (and conventional heat pumps likewise) following every step of the way.

Jonsson's heat pump, while attempting to alleviate overpressurization difficulties by adjusting the evaporator's capacity with a booster segment, did not address the frosting problem in any significantly new way. He only resorted to the well-known expedient of melting the ice, in his case by a "flow of relatively warm refrigerant through the booster heat exchanger for a short time . . . . Once defrosting has been completed, the apparatus is shifted back to the heating mode."

Lindahl and Mochizuki et al provided only another solution to the subsidiary problem of evaporator frosting by sending hot refrigerant through successive isolated sections of an evaporator to melt frost away. There is, of course, a corresponding loss of heat, a corresponding drop in overall efficiency and a resulting drop in space heating capability, although it does enable the heat pump to continue operation—a desirable advancement even if it comes at the price of reduced overall efficiency (heat is always being pumped out of the space into which the heat pump is laboring to bring heat).

The plates of Gay and more particularly the plates of Weis could have been adapted to heat pump use—not as collectors of solar insolation but as extended-surface plates for conductive heat transfer as in my invention—but since they were not so adapted until my invention it is evident that such a change required more than mere mechanical skill.

It is only by attaining these objects just discussed—extended temperature range capability, frost-resistant capability, and capability to use other refrigerants—that a heat pump can be built signifying a clear advance in heat pump technology. It represents a step toward a total but simple system, not one with a backup heat source and defrosting means and safety controls for high pressures. It necessitates a unique adaptation of old methods to introduce this new mode of action and produce this new result.

Taplay's heat pump system only makes the defrosting process more efficient and maintains some sort of heat pump operation during the defrost cycle. It cannot be used to extend heat pump operation to previously unreachable low temperatures.

Jonsson provided a booster evaporator section, but since it was still of a type to frost up, the system provided a diminishing amount of heat as the outside temperature dropped, he teaches, to about −4° C. (25° F.) (perhaps with the system's COP dropping to near unity at that stage?)

Hailey segmented his evaporator, but with the object of purposely making the evaporator become coated with ice, not with the object of keeping the evaporator working in that condition. Hailey's only aim was to use the ice as a heat sink for heat to be removed from a living space.

All of these skilled workers, and others in the art as well, did not discover the combination represented by my invention, the new and useful improvement that meets both the objects of year round operation and freedom from frost problems.

Another object of my invention was to devise a heat pump that could operate continuously without reduced capability. Lowering of efficiency is inherent in systems such as that of Tapley which, while it may continue to run, does so only so the main evaporator can be defrosted. In the Jonsson system, heat pump operation is impaired while the booster is defrosted. The system of my invention is either not pumping heat at all (if the load's thermostats are not calling for heat) or is pumping heat at maximum capacity and at maximum efficiency. There is no interruption in system performance.

A further object of my invention is to provide protection against compressor damage or against system shutdown as a safety precaution when high gas pressure is generated by an evaporator too large for the existing ambient temperature.

Plaster devised a control which involves a complicated mechanical valving to control compressor input, under control of input pressure. This would cause evaporator pressure to climb to keep the compressor operating under its normal load conditions, but would not control evaporator collection of heat, perhaps until high evaporator pressure would cause its Delta T to go down, so the control would not be in the proper direction for a heat pump application.

Anzalone throttled actual refrigerant flow.

Taplay provided a relief valve to the atmosphere if pressure became excessive.

One of the new results inherent in my invention and not obtained by these and other previous persons skilled in the art is that the system protects itself against overpressure by ensuring that suction pressure is governed by the system itself to stay at a desired value. Even though the total evaporator capacity of my invention must be considered to be grossly oversized when compared with that of conventional heat pumps, and therefore a possible contributor to dangerous overpressure conditions, the self-governing action of decreasing evaporator size with rising pressure means that such conditions will not occur.

A further object of my invention is to enable the installation of the required outside evaporator means to be both advantageous for heat pump purposes and pleasing to the eye of an observer. This object is achieved in a practical way by the physical form of the plates and by the freedom to place them almost anywhere desired. On a structure's vertical wall, the plates can function both as system heat absorbers and as shields against winds. The plates can be secluded, or even hidden from view if desired, so that their coating of white frost is not visible when it occurs. If desired, however, the plates may be installed on roofs so they can receive solar insolation, since the system's ability to adjust area will prevent system overload during maximum insolation occasions (although heat pump peformance will be degraded if a thick snow blankets the plates).

Insolation is not considered to be a major source of ambient heat for the system of my invention. It might be thought that insolation collection might reduce the size of the evaporator and thus provide an economy. While it is true that during sunny periods the evaporator would be set to smaller areas by the system, during winter the coldest temperatures usually occur during darkness and the total evaporator must be sized for that condition.

A further object of my invention is to enable the building of a heat pump system simpler than those that have been known and used in the past. This is for purposes of economy in construction, for reliability in use, for ease of maintenance, and for shortening the time necessary for installation. Such simplifications may seem obvious after the fact, and therefore not difficult to envision, but apparently they have not been obvious to persons skilled in the art. Some of the factors of my invention that make for simplicity are: (1) No mechanisms and controls and components and associated piping and wiring are needed for a defrosting system. (2) The evaporator itself is composed of sturdy stationary metal plates, eliminating delicate finned coils, air fans and motors with attendant electrical wiring—greatly reducing the possibility of failure during operation. (3) No superfluous mechanisms like those included in the patents previously mentioned are needed for throttling refrigerant flow, for reversing refrigerant flow, for detecting overpressures and for venting refrigerant, and the like.

All the objects of my invention which have been discussed have been attained in practice. Three heat pump systems of the type of my invention have been installed and tested. Each went into immediate and practical use. All have continued to operate satisfactorily—year round.

One system was installed in late 1981 at the Princeton, N.J., residence of a prominent industrialist. A leading heating and air conditioning engineer designed means for various heating and cooling needs for the new home; he selected my invention for an installation to heat water in a 45,000 gallon indoor swimming pool, specifying a backup heater in case the heat pump couldn't do the job in cold weather. The heat pump system consists of a three hp compressor, a five hp condenser and a three-zone 14-panel roof-mounted evaporator array. The refrigerant in the system is R-12. After initially bringing the pool water temperature to near the target temperature of 95° F., the system has maintained the water at a selected temperature of 89° F. the year round. The backup heater has never been required to furnish heat to the system.

Another system was installed in a Pennsylvania residence in late 1981. It supplies heat to a previously-existing hot water space heating system and a domestic hot water system.

A third system was installed in 1981 in a 2,800 square foot residence in Pennsylvania. It supplies heat to the previously-existing space heating system and to the domestic hot water system. Test instrumentation measured system performance and provided the opportunity to accumulate experience with different refrigerants. First, however, the system demonstrated its ability to operate continuously with varying ambient conditions, maintaining a steady flow of refrigerant and using a steady flow of motor current as outside ambient conditions varied over their ranges and the system accordingly varied the number of active evaporator plates called for by the self-governing action of the system.

With the R-12 first used (boiling point −30° C. (−21° F.)) the system operated satisfactorily with the ambient temperature at the evaporator reaching 37° C. (98° F.) in a strong sun and the system calling for its minimum evaporator area of four plates totaling 96 square feet, and it still pumped heat with ambient temperatures down to about −9° C. (16° F.), the system calling for its maximum evaporator area of 16 plates totaling 384 sq. ft.

But with R-22 (boiling point −41° C. (−41° F.)) in the system, and with expansion valves changed and evaporator zone sizes altered to suit, heat pump action was normal at 36° C. (96° F.) using one plate of 24 sq. ft., and the system using 16 plates totaling 384 sq. ft. was still pumping heat at an outside ambient of −21° C. (−6° F.), well below the temperatures at which conventional heat pumps (even those using auxiliary booster evaporators such as those of the Jonsson patent) have ceased to supply useful amounts of heat.

It is this sort of result in early experimentation which promises being able to push the performance of heat pumps to even higher Btu output and higher COP capability. Heat pump design can progress beyond the restrictions of present day technology which demand what might be termed "creative artistry" in the design stage to coordinate the size and performance abilities of component parts of a heat pump for a specific application in a specific climate zone.

Now, with the ability provided by a huge variable-area evaporator to "dial in" evaporator temperature and compressor suction pressure and refrigerant flow for optimum performance by simply adjusting the settings of pressure or current sensors, regardless of refrigerant choice or size of total evaporator, the heat pump tunes itself for best performance under any condition of ambient temperature and insolation, and without worry about overpressure mishaps or shutdowns. But with even more significance for development of better heat pumps, it will be possible to build systems whose temperature and pressure limits empower refrigerant-cycle envelopes providing performances impossible to attain with presently used refrigerants. As the boiling point of a system's refrigerant is lowered (commonly by choice of a different refrigerant), lower ambient temperatures can be reached, the heat pump still operable because of the increased Delta T. Now, my invention's system makes it possible to achieve lower boiling points by "dialing in" lower suction pressures while still meeting the important criterion of an appropriate high end temperature, important because the refrigerant's critical temperature needs to be high so that output at the condenser can be at high temperature. My invention makes it possible to choose a refrigerant with a high critical temperature, yet by dialing in an ultra low suction pressure move the boiling point of the refrigerant in the evaporator to an ultra-low temperature, thereby attaining a larger Delta T. The result will be to enable the building of more economical heat pumps with higher Btu outputs and with higher COP's. And the ultimate outcome will be that we can perform more of our heating tasks, in more diversified applications, with more efficient heat pumps.

BRIEF DESCRIPTION OF THE DRAWINGS

FIG. 2 is a schematic representation of a zoned evaporator according to the invention;

FIG. 3 is a schematic perspective view of a conventional fixed size finned coil evaporator;

DESCRIPTION OF THE PREFERRED EMBODIMENT

Figure 1:
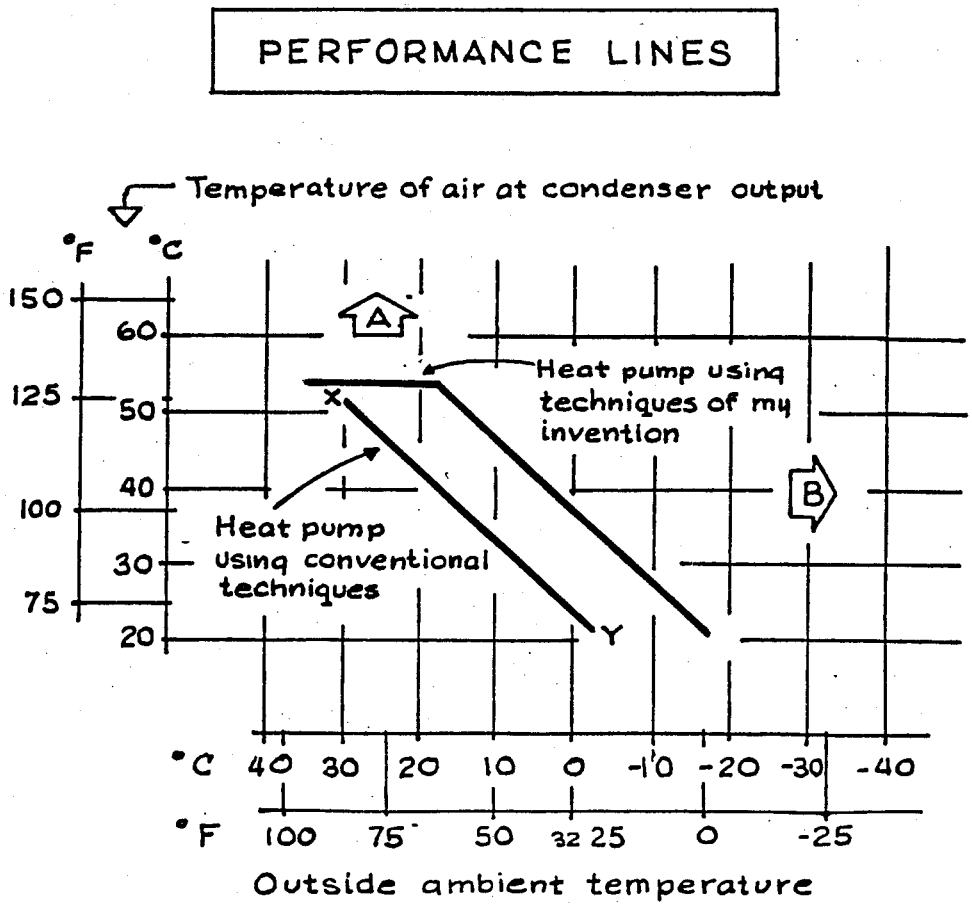
FIG. 1 is a graph comparing the performance of a typical conventional heat pump and the performance of a typical heat pump employing the invention.
Figure 4:
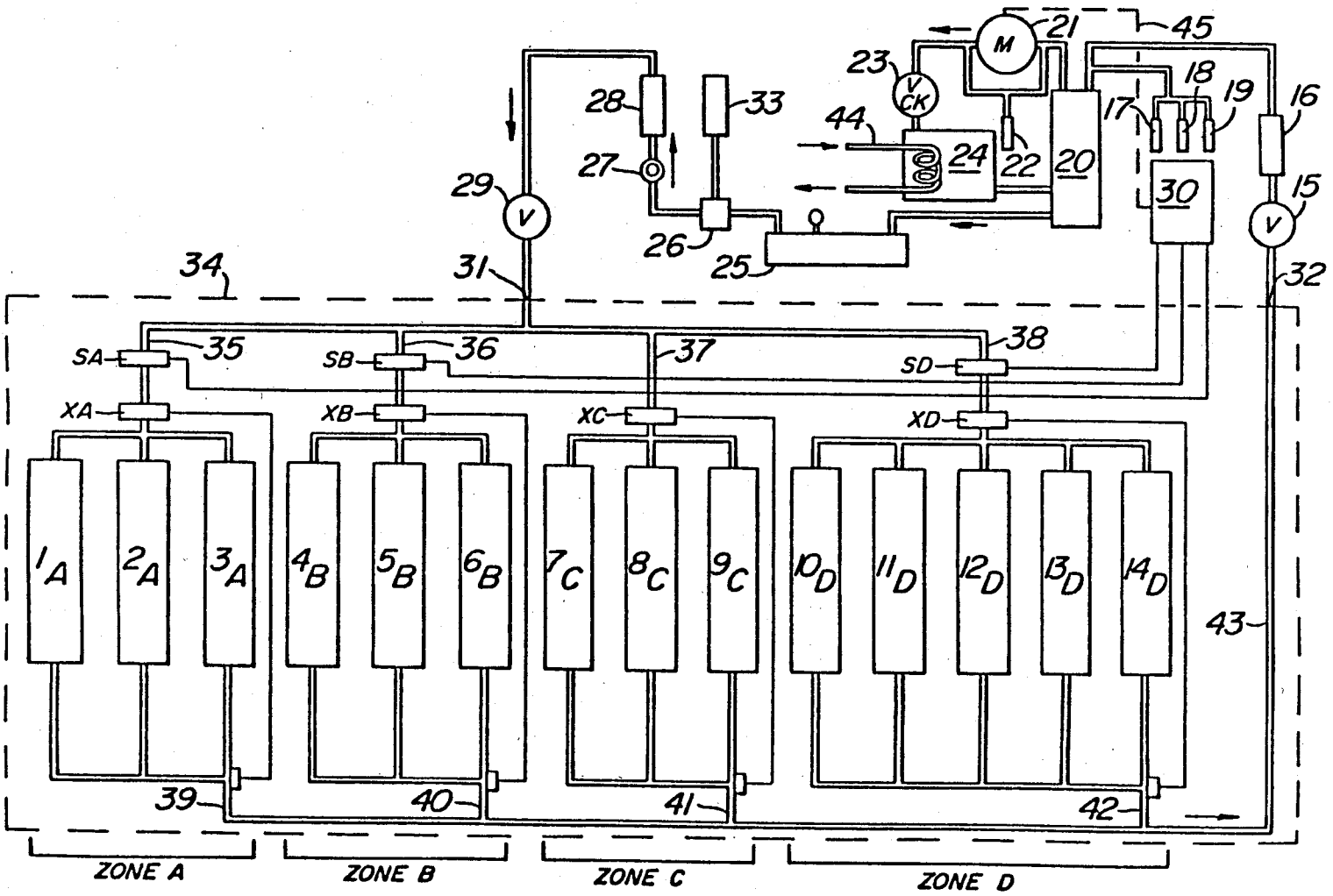
FIG. 4 is a schematic diagram of the heat pump disclosed in this application, incorporating the novel segmented evaporator and its controls.

The heating system diagrammatically illustrated in FIG. 4 is one of the refrigerant-cycle heat pump type that employs a working refrigerant such as R-12. Heat is absorbed by the evaporator means 34 which is located outdoors in the ambient environment, external to the enclosure to be heated, preferably on a vertical wall. An equivalent amount of heat is given off to the interior of the enclosure to be heated by condenser means 24 located therein, which exchanges heat between the refrigerant and a water circuit 44 which is connected to a standard domestic heating system (not shown) or to a reservoir to be heated (not shown). It should be understood that a refrigerant-to-air condenser may be used as well. The outside evaporator means (dashed line 34 encloses the portion of the system which is outside the enclosure to be heated) interfaces with the rest of the heating system at entrance port 31 and exit port 32.

Figure 5:
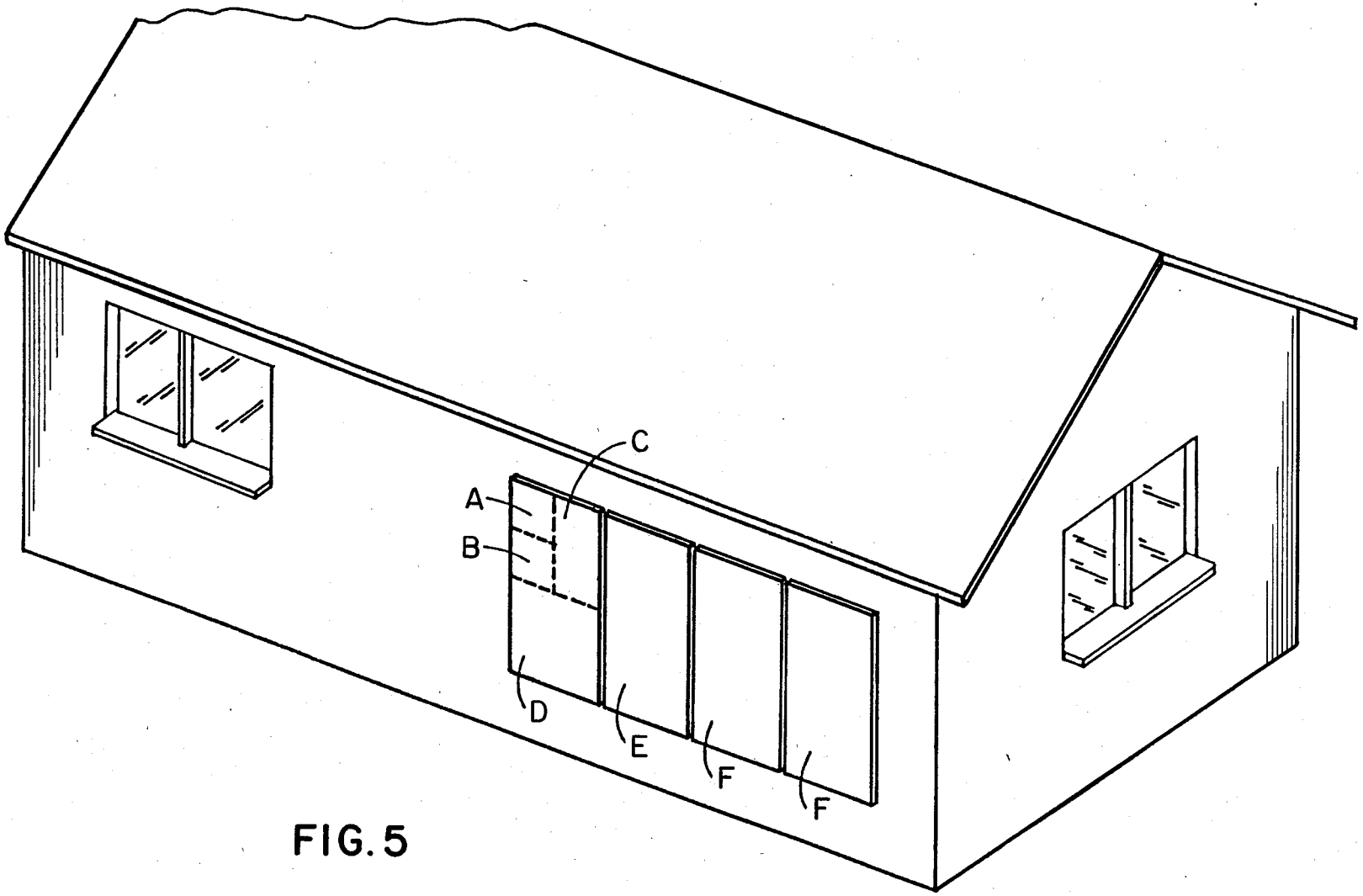
FIG. 5 shows installation of the segmented evaporator on an outdoor vertical wall.

FIG. 4 shows an evaporator plate system sectioned into four zones: one fixed primary zone, C, and three regulated secondary zones, A, B and D. This sectioning is achieved in this example by grouping the fourteen unitary evaporator plates $\mathbf{1}_A$ through $\mathbf{14}_D$ into clusters with conduits connecting them in parallel as illustrated. Each zone has a separate expansion valve, XA, XB, XC and XD, located on its respective distributing conduits 35, 36, 37 and 38. In practical systems, the respective areas of the separate zones are such as to provide areas which increase the total area of the evaporator in approximately a geometric progression as each zone is added to the working evaporator. This is illustrated in FIG. 5, where zone A is the smallest working zone and zones B, C, D, E and F are added in that order.

Thermostat 33 is located within the medium to be heated. When the temperature of the medium decreases below the value at which the thermostat is set, the thermostat transmits an opening command to master shut-off valve 26. Valve 26 opens and liquid refrigerant from receiver 25 flows through it, through sight glass 27, through filter-drier 28, through manual shut-off valve 29 and through entrance port 31 to the outside evaporator. Shut-off valve 29 is included, as is shut-off valve 15, so that the evaporator may be isolated from the rest of the system during installation and maintenance.

The liquid refrigerant is divided among four distributing conduits 35, 36, 37 and 38 which distribute refrigerant into the four zones A, B, C and D respectively by means of solenoid valves SA, SB, conduit 37 and solenoid valve SD. These three solenoid valves are controlled by control circuitry 30 which is actuated by three pressure sensors 17, 18 and 19 that measure suction pressure at the intake of compressor 21. Pressure switch 22 turns off the motor electrical power when either of its minimum or maximum operating parameters is crossed.

The plates of each evaporator zone discharge refrigerant converted to vapor by heat absorbed from the atmosphere into the evaporator plates, through conduits 39, 40, 41 and 42 into a common collecting conduit 43.

From conduit 43 the refrigerant vapor flows through exit port 32 and into the heated structure through shut-off valve 15 to filter 16 and to accumulator 20. On the suction line between filter 16 and accumulator 20 are located the three pressure sensors 17, 18 and 19 and related control circuitry 30.

Refrigerant vapor flows from accumulator 20 to compressor 21, which sends compressed refrigerant gas through one-way check valve 23 to condenser 24. In condenser 24 the hot compressed gas becomes liquid and gives up heat to water circulated through conduit 44. From condenser 24 the liquid refrigerant flows through accumulator 20 then returns to receiver 25.

The evaporator means of my invention's heat pump is located outside of the enclosure to be heated, preferably on a vertical wall as shown by the drawing of FIG. 5. The evaporator can face any direction, so mounting on the rear of a structure for esthetic reasons is possible. The plates are mounted so as to provide air circulation on both sides of the plates, with space between the plates and the supporting wall, and with room top and bottom for air flow for both front and back of the plates. If desired the plates may be painted to blend in with the color of the walls to make them "blend in" to the structure. But the plates should not be mounted on walls that are closely bounded by bushes that might hamper air flow to the plates.

OPERATION

Excepting the novel evaporator system with controls, the rest of the heat pump operates in a manner hereinbefore described and well known to those skilled in the art, and therefore primary attention will now be given to the novel evaporator system and its controls.

The evaporator system of this invention operates on the fundamental principle that as refrigerant flows through an evaporator more evaporator surface area will increase the heat absorption from ambient air to refrigerant and will hence increase refrigerant pressure within the heat pump cycle and conversely less evaporator area will reduce the pressure. Such an area change can be achieved as herein disclosed by the use of distributing conduits, solenoid valves and associated controls whereby refrigerant flow may be directed into a greater or lesser number of evaporator segments thereby changing the working surface area of the evaporator system.

This invention also operates on the principle that formation of frost on the external surface of an evaporator plate diminishes slightly but does not interrupt entirely the heat absorbing performance of said plate. When frost does form, uniform performance of the heat pump system is achieved by directing refrigerant flow to a greater evaporator area so that the total heat absorption by the evaporator is maintained.

Such uniform performance of an evaporator has never before been achieved in the art.

In the mode of operation depicted in FIG. 4, a need for heat to be pumped to the medium being heated causes thermostat 33 to open valve 26 at the outlet of receiver 25. This action allows liquid refrigerant to flow to the evaporator. There, it flows to all zones of the evaporator because valves 35, 36 and 38 are open to refrigerant flow. They are open because, with the heat pump in a quiescent state, the compressor is not running and pressure sensors 17, 18 and 19 are not (through control circuitry) commanding the valves to close.

Flow of liquid refrigerant into all zones of the evaporator (at this stage all piped together to comprise one large evaporator) soon establishes a flow of refrigerant gas at the evaporator output conduit 43 when heat absorbed from the outside environment vaporizes the refrigerant. Compressor pressure switch 22 is activated by the rise in pressure and turns on electrical power to the motor, and the compressor starts up. With the compressor running, conventional refrigerant cycle heat pump operation occurs in a manner well known to those skilled in the art.

But soon the novel evaporator system begins its management to maintain a predetermined flow of refrigerant gas to the compressor. Under usual conditions the totality of evaporator plates provides more heat absorbing capability than required and evaporator output of vaporized refrigerant becomes more and more pressurized. Pressure would soon rise beyond safe limits and damage the compressor were it not for the control means. When pressure sensor 17 detects that the existing ambient condition causes the suction pressure to rise above the value for which switch 17 has been set, switch 17 commands that solenoid valve SD be closed, thereby shutting off liquid refrigerant flow to evaporator zone D. This reduction in evaporator heat absorbing capacity results in less heat being added to the refrigerant flow and thereby lessens the generation of pressure in the refrigerant gas.

If the remaining evaporator surface area is still too great for existing ambient conditions pressure sensor 18 for zone B will detect the increasing pressure and cause solenoid valve SB to close, shutting off refrigerant flow to zone B. Similarly, if the evaporator area is still too great, pressure sensor 19 will command solenoid valve SA to close, shutting off liquid refrigerant flow to zone A. That will leave zone C, the smallest zone of the evaporator, as the active zone for the heat pump system. The steps of control just described, in an operating system, span only a few seconds. Zone C has no solenoid valve flow control and is always operating when valve 26 allows refrigerant flow to the evaporator.

If the ambient temperature falls because of clouds obscuring the sun, an onset of cold winds, approaching nightfall or the like, resulting in a drop in suction pressure, the pressure sensors in the system will open their corresponding solenoid valves to restore evaporator capacity sufficiently to maintain a predetermined pressure. On the hottest summer day the system when calling for heat (for domestic hot water, for example) will operate with only the smallest zone receiving liquid refrigerant and the compressor will receive refrigerant gas at a predetermined pressure. On a cold winter night a greater area will receive liquid refrigerant, and the totality of evaporator surface will transfer sufficient heat to the refrigerant to cause it to maintain the same predetermined pressure, and heat pump operation will still furnish the same amount of heat to the medium being heated.

When frost forms on evaporator surfaces, as it is likely to do—has been observed to do—except during midwinter because of lowered relative humidity, and thereby slightly impedes transfer of heat from air to refrigerant, the evaporator control system will compensate by opening up more zone area to maintain constant flow at constant pressure to the compressor.

Another mode of working the evaporator control in this invention is to replace the pressure sensors with electrical current sensors located in the supply line to the compressor motor, as depicted by the dashed electrical line 45. Using the power demand of the compressor motor as the input parameter, electrical circuitry well known in the electrical art may be employed to selectively open or close the evaporator solenoid valves.

Using this control mode, the power sensors on the motor supply line sense the electrical demand of the motor. It has been observed that as the suction line pressure increases, the current demand of the compressor motor increases in direct relation thereto. Hence, the power demand of the motor may be used as an input variable to control the evaporator system to maintain constant suction pressure, using logic and switching circuitry well known in the electrical art to actuate solenoid valves in the evaporator system.

Operation of the heat pump system continues until thermostat 33 signals that the temperature of the medium being heated has reached the desired maximum, thereby closing valve 26, which will result in the compressor being turned off when sensor 22 detects a pressure drop to a predetermined minimum.

As an indication of typical sizes of major elements of a heat pump system of the invention, a system using refrigerant-12 has evaporator plates 36 inches by 96 inches by ¼ inch, made of roll-bonded copper or aluminum, a compressor and motor rated at three tons of refrigeration capacity and expansion valves rated at one ton each. Another existing system using refrigerant-22 has a five-zone evaporator A1, B1, C2, D4 and E8, the letter designating the zone, the numeral designating the number of unitary plates in the zone. Individual zone area, cumulative area as zones are added to evaporator capacity, and ratings of expansion valves for each zone are as shown in the following table:

| Zone | Area | Total area | Expansion valve rating |
|---|---|---|---|
| A1 | 24 sq ft | 24 sq ft | ¼ ton |
| B1 | 24 sq ft | 48 sq ft | ¼ ton |
| C2 | 48 sq ft | 96 sq ft | ½ ton |
| D4 | 96 sq ft | 192 sq ft | 1 ton |
| E8 | 192 sq ft | 384 sq ft | 2 × 1 ton |

Figure 6:
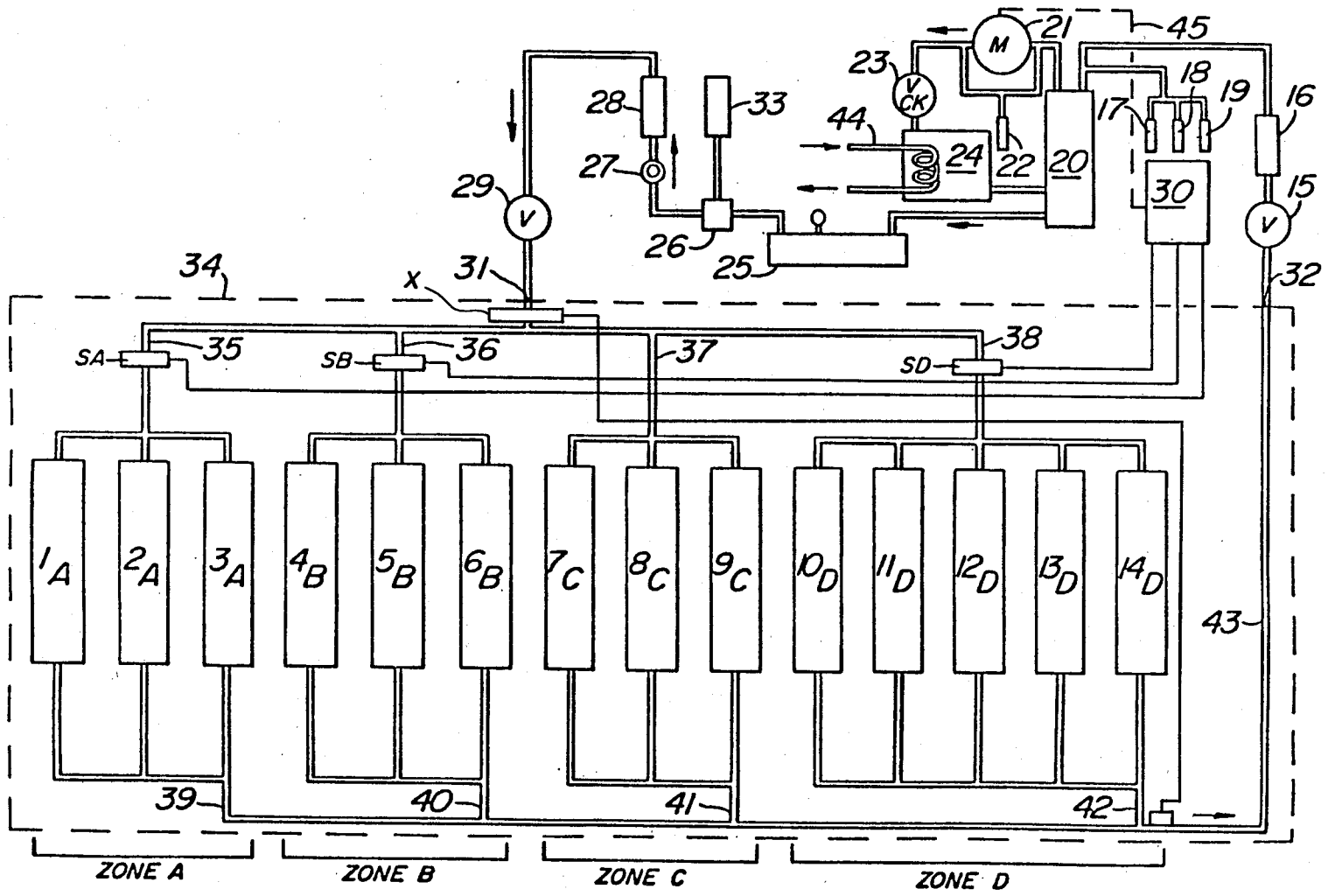
FIG. 6 is a schematic diagram of part of the heat pump of FIG. 4 illustrating a modification thereto.

It should be apparent to those skilled in the art that one can devise many different evaporator systems of the type disclosed herein using the methods and principles hereinabove described. Variations of this type may have any number or design of plates, zone area and expansion valves as desired. For example, it may become more practical to use one master expansion valve X located inmmediately upstream of the evaporator entrance port as illustrated in FIG. 6, rather than employing separate expansio n valves for each zone. Furthermore, it should also be pointed out that the various expansion valves need not be balanced; that is, not all must have the same capacity (as indicated in the table shown above). Each valve should, of course, be matched in capacity to the zone it serves. This design flexibility may be exploited to further extend the operating range of the system.

Also, it should be apparent that a given evaporator system of the type disclosed herein may have as many zones as it has unitary evaporator plates. A system which has the greatest number of operating zones for a given number of evaporator plates would be structured so that each plate constitutes a separate zone with each zone having an individual shut-off valve. Furthermore, the individual two-sided evaporator plates may be replaced by any other suitable frost-resistant unitary evaporator means, and each zone may have a different area.

Although specific embodiments of the invention have been disclosed for illustrative purposes, it will be appreciated by those skilled in the art that many additions, modifications and substitutions are possible without departing from the scope and spirit of the invention as described in the accompanying claims. For example, it will be recognized by those skilled in the art that the heat pump of my invention can, with only minor adjustment, operate to provide cooling of living spaces during times when such cooling is desired, still providing heat for domestic hot water.

What is claimed is:

1. A heat pump system comprising a refrigerant, expansion valve means, an evaporator, a condenser and a compressor, the evaporator being located so as to be subjected to an environment having varying temperatures, the heat pump system being coupled to extract heat from the enviroment via the refrigerant passed through the evaporator and to deliver extracted heat to the condenser, wherein the improvement comprises:

the heat pump system extracting heat from the environment and delivering a substantially constant quantity of extracted heat to the condenser via the refrigerant substantially independently of the environment temperature as the environment temperature varies in a given temperature range, the evaporator having at lease three working sizes, the heat pump system including means for sensing a system parameter relating to a condition of the refrigerant inside the heat pump system, the heat delivered to the condenser being related to the condition of the parameter, and means for selectively coupling a working size of the evaporator in response to the sensed condition of the system parameter for operation in the heat pump system so as to maintain the system parameter substantially at a predetermined value and hence maintain the quantity of extracted heat delivered to the condenser substantially constant as the environment temperature varies in the given temperature range.

2. The heat pump system according to claim 1 wherein a substantial portion of the evaporator comprises continuous, plate-like heat transferring surfaces extending between the refrigerant and the environment operable to absorb sufficient environmental heat by conduction with a coating of frost or ice thereon to enable the heat pump system to operate in the given temperature range while the system parameter is maintained substantially at the predetermined value.

3. The heat pump system according to claim 1 wherein the system parameter is the suction pressure of the compressor, and wherein the sensing means senses the suction pressure of the compressor and the coupling means in response thereto couples a working size of the evaporator for operation in the heat pump system so as to maintain the compressor suction pressure substantially at the predetermined value in the given temperature range.

4. The heat pump system according to claim 1 wherein the system parameter is the pressure of the refrigerant leaving the evaporator, and wherein the sensing means senses the pressure of the refrigerant leaving the evaporator and the coupling means in response thereto couples a working size of the evaporator for operation in the heat pump system so as to maintain the pressure of the refrigerant leaving the evaporator substantially at the predetermined value in the given temperature range.

5. The heat pump system according to claim 1 wherein the system parameter is the electrical current demand of the compressor, and wherein the sensing means senses the electrical current demand of the compressor and the coupling means in response thereto couples a working size of the evaporator for operation in the heat pump system so as to maintain the electrical current demand of the compressor substantially at the predetermined value in the given temperature range.

6. The heat pump system according to claim 1 wherein the evaporator comprises a plurality of operating zones which in their totality provide an evaporator working size in excess of that which is required when the heat pump system is operating in an upper region of the given temperature range, and wherein the coupling means couples a number of evaporator zones for operation in the heat pump system in response to the condition of the system parameter sensed by the sensing means so as to maintain the system parameter substantially at the predetermined value.

7. The heat pump system according to claim 6 wherein the coupling means includes shutoff valves controlling the flow of refrigerant to the operating zones of the evaporator, the evaporator operating zones being connected in parallel and a separate shutoff valve being provided to control refrigerant flow to each zone, the coupling means operating the shutoff valves in response to the condition of the system parameter sensed by the sensing means so as to maintain the system parameter substantially at the predetermined value.

8. The heat pump system according to claim 7 wherein the expansion valve means comprises a plurality of individual expansion valves with at least one individual expansion valve being connected to each evaporator zone downstream of the respective shutoff valve.

9. The heat pump system according to claim 8 wherein the total capacity of the expansion valve or valves feeding one of the zones is different from the total capacity of the expansion valve or valves feeding at least one other zone, and wherein the expansion valve or valves feeding each zone have a capacity conforming to the working size of that zone.

10. The heat pump system according to claim 9 wherein the working size of each of the evaporator zones is a multiple of the working size of at least one other evaporator zone.

11. The heat pump system according to claim 7 wherein the expansion valve means comprises a single expansion valve disposed upstream of and feeding all of the shutoff valves.

12. The heat pump system according to claim 7 wherein the shutoff valves comprise electromechanical solenoid shutoff valves.

13. The heat pump system according to claim 6 wherein the operating zones of the evaporator each comprises one or more evaporator segments formed by continuous plate-like surfaces operable to absorb sufficient environmental heat by conduction with a coating of frost or ice thereon to enable the heat pump system to operate in the given temperature range while the system parameter sensed by the sensing means is maintained substantially at the predetermined value.

14. The heat pump system according to claim 13 wherein each of the evaporator zones contains a number of segments which is a multiple of the number of segments contained in at least one other evaporator zone.

15. The heat pump system according to claim 2 wherein the evaporator is mounted so that its working surfaces extend generally vertically.

16. The heat pump system according to claim 1 wherein the coupling means includes means for varying the setting of the value of the system parameter which is sensed by the sensing means at which it is to be substantially maintained.

17. The heat pump system according to claim 1 wherein the given temperature range exceeds 5° F., and wherein the coupling means couples an evaporator working size for operation in the heat pump system, and the heat pump system is operable, to extract heat from the environment and deliver a substantially constant quantity to the condenser as the environment temperature varies in the given temperature range exceeding 5° F.

18. A heat pump system comprising a refrigerant, expansion valve means, an evaporator, a condenser and a compressor, the evaporator being located so as to be subjected to an environment having varying temperatures, the heat pump system being coupled to extract heat from the environment via the refrigerant passed through the evaporator and to deliver extracted heat to the condenser, wherein the improvement comprises:

the heat pump system extracting heat from the environment and delivering a substantially constant quantity of extracted heat to the condenser via the refrigerant substantially independently of the environment temperature as the environment temperature varies in a given temperature range, the evaporator having a variable working size, the heat pump system including means for sensing a system parameter relating to a condition of the refrigerant inside the heat pump system and outside of the evaporator, the heat delivered to the condenser being proportional to the condition of the parameter, means for selectively coupling a working size of the evaporator in response to the sensed condition of the system parameter for operation in the heat pump system so as to maintain the system parameter substantially at a predetermined value as the environment temperature varies in the given temperature range, the evaporator comprising at least three operating zones which in their totality provide an evaporator working size in excess of that which is required when the heat pump system is operating in an upper region of the given temperature range, and wherein the coupling means selects and couples for operation in the heat pump system a number of evaporator zones so as to maintain the system parameter substantially at the predetermined value, the expansion valve means comprising a plurality of individual expansion valves with at least one individual expansion valve being connected to each evaporator zone, the expansion valve or valves connected to each zone conforming to the working size of the respective zone, a substantial portion of the evaporator comprising continuous, plate-like heat transferring surfaces extending between the refrigerant and the environment operable to absorb sufficient environmental heat by conduction with a coating of frost or ice thereon to enable the heat pump system to operate in the given temperature range while maintaining the system parameter substantially at the predetermined value, the heat pump system thereby extracting heat from the environment and delivering the substantially constant quantity of extracted heat to the condenser in the given temperature range substantially independently of the environmental temperature and formation of frost or ice on the evaporator.

19. A method for extracting heat from a first location and delivering it to a second location utilizing a heat pump system comprising a refrigerant, expansion valve means, an evaporator, a compressor and a condensor, wherein the evaporator is located at the first location and subjected to an environment having varying temperatures and the condenser is located at the second location, wherein the improvement comprises:

extracting heat from the first location and delivering a substantially constant quantity of extracted heat to the condenser in the second location substantially independently of the environment temperature as the environment temperature varies in a given temperature range, the method including the steps of providing an evaporator having at least three working sizes, sensing a system parameter relating to a condition of the refrigerant inside the system and in response thereto selectively coupling a working size of the evaporator for operation in the heat pump system so as to maintain the system parameter substantially at a predetermined value as the environment temperature varies in the given temperature range, thereby maintaining the quantity of extracted heat delivered to the condenser in the second location substantially constant.

20. The method according to claim 19 including the step of selecting the predetermined value of the system parameter at which it is to be substantially maintained, the minimum environmental temperature at which the system is operable being determined by the value selected of the system parameter and the particular refrigerant used.

21. The method according to claim 19 wherein the system parameter is the suction pressure of the compressor.

22. The method according to claim 19 wherein the system parameter is the pressure of the refrigerant leaving the evaporator.

23. The method according to claim 19 wherein the system paramenter is the electrical current demand of the compressor.

24. The heat pump system according to claim 19 including the step of selecting the capacity of the expansion valve means to correspond to the working size of the evaporator coupled for operation in the heat pump system.

25. The method according to claim 19 wherein the working sizes of the evaporator are provided in multiples of a smallest evaporator working size.

26. The method according to claim 19 wherein the evaporator has a plurality of working zones each of which is supplied with refrigerant through a separate expansion valve, the method including the step of providing expansion valve means for each evaporator zone having a capacity conforming to the working size of the evaporator zone it supplies.

27. The method according to claim 19 wherein the given temperature range exceeds about 5° F.

28. The method according to claim 19 wherein heat is extracted from the environment at an environmental temperature below about 32° F. via the evaporator and delivered to the condenser with a temperature available at the output of the condenser of at least about 90° F.

29. The method according to claim 19 wherein heat is extracted from the environment by the evaporator and delivered to the condenser in a temperature range of approximately 50° F. while the temperature available at the output of the condenser is greater than about 100° F.

30. The heat pump system according to claim 18 wherein the given temperature range exceeds about 5° F.

* * * * *